US010323345B2

(12) United States Patent
Schiller et al.

(10) Patent No.: US 10,323,345 B2
(45) Date of Patent: Jun. 18, 2019

(54) MATTRESS WITH CASING HAVING A QUILTED LAYER OF HIGH DENSITY FOAM METHOD AND SYSTEM FOR MAKING SAME

(71) Applicants: Stephen J. Schiller, Naples, FL (US); Ryan B. Bethea, Estero, FL (US)

(72) Inventors: Stephen J. Schiller, Naples, FL (US); Ryan B. Bethea, Estero, FL (US)

(73) Assignee: PRANASLEEP, LLC, Bonita Springs, FL (US)

( * ) Notice: Subject to any disclaimer, the term of this patent is extended or adjusted under 35 U.S.C. 154(b) by 355 days.

(21) Appl. No.: 15/210,953

(22) Filed: Jul. 15, 2016

(65) Prior Publication Data

US 2017/0088990 A1 Mar. 30, 2017

(51) Int. Cl.

| | |
|---|---|
| ***A47C 27/00*** | (2006.01) |
| ***D05B 11/00*** | (2006.01) |
| ***A47C 27/14*** | (2006.01) |

(52) U.S. Cl.

CPC ..... *D05B 11/00* (2013.01); *A47C 27/002* (2013.01); *A47C 27/14* (2013.01)

(58) Field of Classification Search

CPC ..... A47C 27/00; A47C 27/002
USPC ..... 5/737, 740
See application file for complete search history.

(56) References Cited

U.S. PATENT DOCUMENTS

| | | | | |
|---|---|---|---|---|
| 4,042,986 | A * | 8/1977 | Goodman | A47C 27/05 5/500 |
| 5,355,816 | A | 10/1994 | Echevarria | |
| 5,461,737 | A | 10/1995 | Ikeda et al. | |
| 5,974,609 | A | 11/1999 | Nunez et al. | |
| 7,886,385 | B2 | 2/2011 | Carlitz | |
| 2002/0015817 | A1 | 2/2002 | Lieblein | |
| 2010/0072676 | A1* | 3/2010 | Gladney | A47C 27/148 264/510 |
| 2011/0083279 | A1 | 4/2011 | Abrigo et al. | |
| 2013/0283537 | A1 | 10/2013 | Azevedo | |
| 2014/0183403 | A1* | 7/2014 | Peterson | C09K 5/14 252/75 |

* cited by examiner

*Primary Examiner* — Fredrick C Conley
(74) *Attorney, Agent, or Firm* — Edward M. Livingston, Esq.; Bryan L. Loeffler, Esq.; Livingston Loeffler, P.A.

(57) ABSTRACT

A mattress and method and system for making said mattress having a mattress casing 1 having a quilted top sleep panel (2) wherein one or more layers of high density foam (3) are stacked and quilted between an outer layer of fabric (4) and an inner layer of fabric (5). The high density foam is preferably Talalay foam and the panel may have multiple layers of high density foam and other materials such as wool, cotton batting and so forth. The inner layer of fabric, outer layer of fabric and at least one layer of high density foam are secured or quilted together by placing a plurality of stitched lines (7) across the area of the panel. The method and system of the present invention allows the high density foam to be continuously quilted without sewing needles being deflected or binding occurring.

14 Claims, 2 Drawing Sheets

MATTRESS WITH CASING HAVING A QUILTED LAYER OF HIGH DENSITY FOAM METHOD AND SYSTEM FOR MAKING SAME

FIELD OF THE INVENTION

This invention relates to mattresses and more particularly, a mattress casing having a specially quilted top layer with one or more layers of high density foam.

BACKGROUND OF THE INVENTION

A typical mattress includes a body, generally rectangular in shape, sandwiched between a covering or casing having a top sleep panel and a bottom panel that rests against a box spring or other support. The top sleep panel and bottom panel are connected by a peripheral band that surrounds the side edges of the mattress body. The top sleep panel normally includes a padded material sandwiched between an inner fabric layer and an outer fabric layer. The padding is integrated with the inner fabric layer and outer fabric layer by lines of stitching placed across the entire area of the upper sleep panel, thereby creating a quilted panel. The bottom panel may also have a similar construction.

Conventional methods of quilting panels are dependable when using material, such as cloth, batting and foam, having a low density that allows the needles performing the stitching to freely pass through the plurality of layers at a relatively high rate of speed.

However, such conventional methods cannot be used on panels having layers with a high density foam, such as Talalay foam. When attempting to quilt high density foams using conventional methods, the layers will bind, bunch, break needles and in some cases break the quilting machine.

Therefore, a need exists for a method and system for creating a mattress casing having a quilted top sleep panel and/or quilted bottom panel having one or more layers of high density foam.

SUMMARY OF THE INVENTION

The primary object of the present invention is to provide mattress casing having a quilted top sleep panel and/or quilted bottom panel having one or more layers of high density foam.

An additional object of the present invention is to provide a method and system of making the above mattress casing.

The present invention fulfills the above and other objects by providing a mattress casing having a quilted top sleep panel wherein one or more layers of high density foam are stacked and quilted between an outer layer of fabric and an inner layer of fabric. The high density foam is preferably a foam made using the Talalay process and the panel may have multiple layers of high density foam and other materials such as wool, cotton batting and so forth. The inner layer of fabric, outer layer of fabric and at least one layer of high density foam are secured or quilted together by placing a plurality of stitched lines across the area of the upper sleep panel. A bottom panel of the casing may also comprise one or more layers of quilted high density foam sandwiched between an inner lay of fabric and an outer layer of fabric.

The mattress casing further includes a peripheral band connecting perimeter edges of the top sleep panel and bottom panel. The peripheral band surrounds side edges of the mattress body.

The method and system of the present invention includes stretching the inner layer, outer layer and one or more layers of high density foam prior to and during the quilting process, forming the stitched lines at a slower rate of speed and other steps to prevent binding of the materials and/or deflection of the needles being used to quilt the layers of material.

The method and system of the present invention also includes preparing elongated strips of high density foam from formed blocks of high density foam wherein multiple sections of sliced foam having a desired thickness are glued end to end to form rolls of high density foam.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF THE DRAWINGS

In the following detailed description, reference will be made to the attached drawings in which.

DESCRIPTION OF THE PREFERRED EMBODIMENTS

Figure 1:
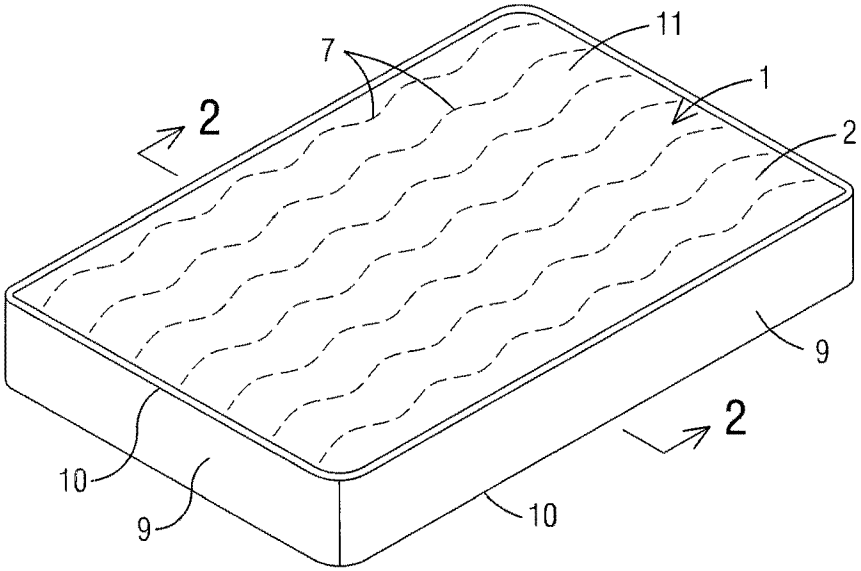
FIG. 1 is a top perspective view of a mattress body encased within a mattress casing of the present invention.

For purposes of describing the preferred embodiment, the terminology used in reference to the numbered accessories in the drawings is as follows:

1. mattress casing, generally
2. top sleep panel
3. high density foam
4. outer layer of panel
5. inner layer of panel
6. alternative material
7. stitched line
8. bottom panel
9. peripheral band
10. perimeter edge of panel
11. mattress body
12. side of mattress body
13. sliced panel of high density foam
14. elongated strip of high density foam With reference to FIGS. 1-4, the mattress casing 1 of the present invention comprises a quilted top sleep panel 2 wherein one or more layers of high density foam 3 are stacked and quilted between an outer layer 4 of fabric and an inner layer 5 of fabric. The at least one layer of high density foam 3 is preferably a Talalay foam or equivalent foam having a density measuring between 1.5-8 pounds per 1 cubic foot. The top sleep panel 2 may have multiple layers of high density foam 3 and additional layers of alternative materials 6, such as wool, cotton batting and so forth. The inner layer 5 of fabric, outer layer 4 of fabric and at least one layer of high density foam 3 are secured or quilted together by placing a plurality of stitched lines 7 across the area lengthwise and/or widthwise of the top sleep panel 2. A bottom panel 8 of the casing 1 may also comprise one or more layers of quilted high density foam 3 sandwiched between an outer layer 4 of fabric and an inner layer 5 of fabric.

Figure 2:
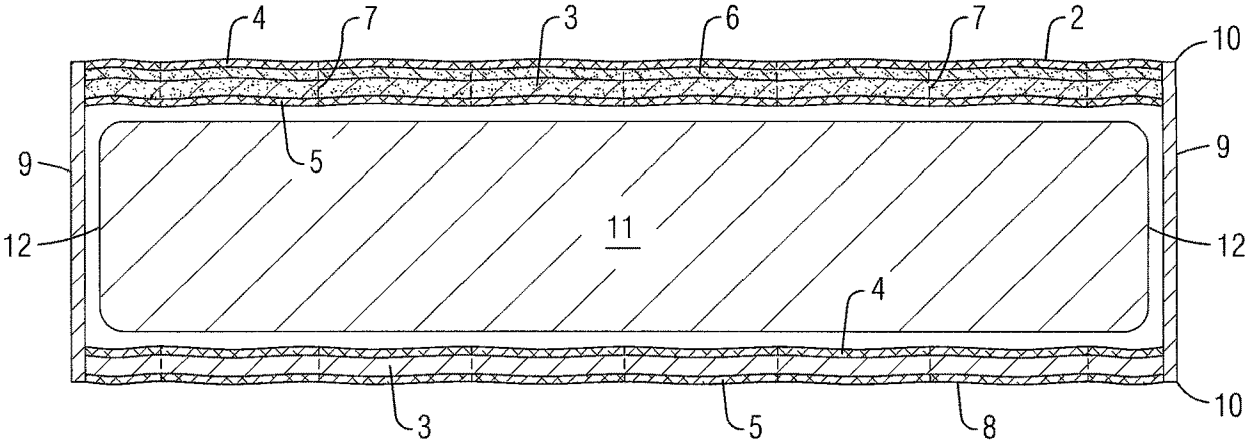
FIG. 2 is a sectional view along line 2-2 of FIG. 1.

The mattress casing 1 further comprises a peripheral band 9 connecting perimeter edges 10 of the top sleep panel 2 and bottom panel 8. The peripheral band 9 surrounds sides 12 of a rectangular-shaped mattress body 11, as illustrated in FIGS. 1 and 2.

Figure 3:
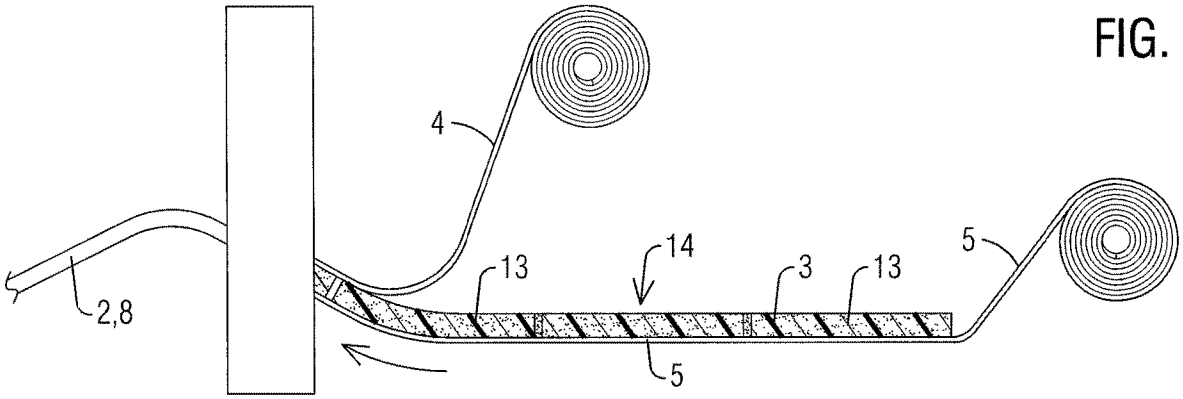
FIG. 3 is a side view of an outer layer, elongated strip of high density foam and inner layer being fed into a sewing machine.

High density foam, such as Talalay foam, is normally formed into large blocks during the molding process. In order to ready the high density foam for the quilting process, the blocks of high density foam must be sliced into panels having a desired height or thickness. The panels of high density foam comprise a front edge, a rear edge and side edges. The sliced panels 13 of high density foam are then formed into elongated strips of high density foam 14 by securing a rear edge of a first panel of high density foam to a front edge of a second panel of high density foam using an attachment means, such as an adhesive, as illustrated in FIG. 3. This may be accomplished by laying the second panel of high density foam on top of the first panel of high density foam, applying adhesive to the edges being secured to each other and then flipping the second panel of high density foam over so that the front edge of the second panel of high density foam abuts the rear edge of the first panel of high density foam. This process may then be repeated as necessary using additional panels of high density foam to obtain an elongated strip of desired length. An elongated strip of high density foam is necessary for the manufacturing process so that a sewing machine can be constantly fed the outer surface of fabric, inner surface of fabric and one or more elongated strips of high density foam.

In addition, the same process may be used to increase the width of the elongated strip of high density foam by adhering additional sliced panels of high density foam to the first panel, second panel and so forth to obtain a desired width.

Figure 4:
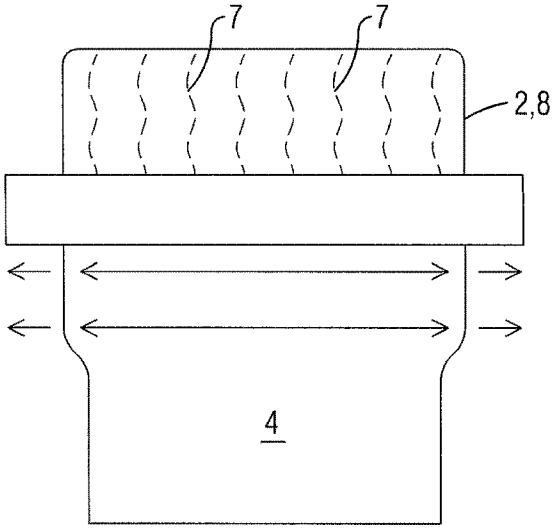
FIG. 4 is a top view of an outer layer, elongated strip of high density foam and inner layer being fed into a sewing machine with outward tension being applied thereto.

With conventional foam and other materials, sewing needles freely pierce the layers without encountering any excess amounts of friction. This allows conventional materials to be freely fed into a sewing machine without tension being placed on the materials. In contrast, high density foams are more difficult to pierce, thereby causing deflection or bending of sewing needle. After a needle does puncture the high density foam, the friction from the compression of the foam may cause binding of the materials. Therefore, outward tension must be applied to the side edges of the materials being quilted, as illustrated in FIG. 4, thereby stretching the inner layer, outer layer and one or more layers of high density foam prior to and during the quilting process. This allows the one or more needles to pierce the high density foam and prevents binding. This further reduces the likelihood of the one or more needles deflecting when piercing the high density foam and/or binding. The bottom panel may be constructed using the same method and system.

Finally, the quilted top sleep panel 2 and bottom panel 8 are each cut to a desired size (if necessary) and attached to the peripheral band 9 around a rectangular-shaped mattress body 11, thereby encasing the rectangular-shaped mattress body 11.

It is to be understood that while a preferred embodiment of the invention is illustrated, it is not to be limited to the specific form or arrangement of parts herein described and shown. It will be apparent to those skilled in the art that various changes may be made without departing from the scope of the invention and the invention is not to be considered limited to what is shown and described in the specification and drawings.

We claim:

1. A method of for making a mattress casing comprising a quilted top sleep panel wherein at least one layer of high density foam is stacked and quilted between an outer layer of fabric and an inner layer of fabric, said method comprising the steps of:

creating a top sleep panel by placing a layer of high density foam between an outer layer of fabric and an inner layer of fabric;

said layer of high density foam having a density measuring between 1.5-8 pounds per 1 cubic foot;

applying an outward tension on side edges of said layer of high density foam of the top sleep panel, thereby stretching the layer of high density foam in an outward direction;

feeding said layer of high density foam, said outer layer of fabric and said inner layer of fabric of the top sleep panel into a sewing machine having at least one needle while maintaining the outward tension on said layer of high density foam;

placing lines of stitching across the layer of high density foam, said outer layer of fabric and said inner layer of fabric of the top sleep panel using said sewing machine while maintaining the outward tension on said layer of high density foam; and securing the top sleep panel to a peripheral band and bottom panel to create the mattress casing of the present invention.

2. The method of claim 1 further comprising a step of:

encasing a mattress body within the mattress casing.

3. The method of claim 1 further comprising a step of:

placing at least one layer of alternative materials between the outer layer of fabric and the inner layer of fabric of the top sleep panel.

4. The method of claim 1 further comprising steps of:

creating a bottom panel by placing a layer of high density foam between an outer layer of fabric and an inner layer of fabric;

said layer of high density foam of the bottom panel having a density measuring between 1.5-8 pounds per 1 cubic foot;

applying an outward tension on side edges of said layer of high density foam of the bottom panel, thereby stretching the layer of high density foam in an outward direction;

feeding said layer of high density foam, said outer layer of fabric and said inner layer of fabric of the bottom panel into a sewing machine having at least one needle while maintaining the outward tension on the layer of high density foam; and placing lines of stitching across the layer of high density foam, said outer layer of fabric and said inner layer of fabric of the bottom panel using said sewing machine.

5. The method of claim 1 further comprising steps of:

forming a plurality of high density foam panels into a single elongated strip of high density foam having a predetermined thickness to create the layer of high density foam of the top sleep panel.

6. The method of claim 4 further comprising steps of:

forming a plurality of high density foam panels into a single elongated strip of high density foam having a predetermined thickness to create the layer of high density foam of the bottom panel.

7. The method of claim 1 wherein:

said high density foam layer is a Talalay foam.

8. A system of for making a mattress casing comprising a quilted top sleep panel wherein at least one layer of high density foam is stacked and quilted between an outer layer of fabric and an inner layer of fabric, said system comprising:

a top sleep panel being created by a layer of high density foam being placed between an outer layer of fabric and an inner layer of fabric;

said layer of high density foam having a density measuring between 1.5-8 pounds per 1 cubic foot;

an outward tension being applied on side edges of said layer of high density foam of the top sleep panel, thereby stretching the layer of high density foam in an outward direction;

said layer of high density foam, said outer layer of fabric and said inner layer of fabric of the top sleep panel being fed into a sewing machine having at least one needle while the outward tension on the layer of high density foam is maintained;

at least one line of stitching being placed across the layer of high density foam, said outer layer of fabric and said inner layer of fabric of the top sleep panel using said sewing machine while maintaining the outward tension on said layer of high density foam; and the top sleep panel being secured to a peripheral band and bottom panel to create the mattress casing of the present invention.

9. The system of claim 8 wherein:

said high density foam is a Talalay foam.

10. The system of claim 8 further comprising:

a mattress body being encased within the mattress casing.

11. The system of claim 8 further comprising:

at least one layer of alternative materials being placed between the outer layer of fabric and the inner layer of fabric of the top sleep panel.

12. The system of claim 8 further comprising:

a bottom panel being created by a layer of high density foam being placed between an outer layer of fabric and an inner layer of fabric;

said layer of high density foam of the bottom panel having a density measuring between 1.5-8 pounds per 1 cubic foot;

an outward tension being applied on side edges of said layer of high density foam of the bottom panel, thereby stretching the layer of high density foam in an outward direction;

said layer of high density foam, said outer layer of fabric and said inner layer of fabric of the bottom panel being fed into a sewing machine having at least one needle while the outward tension on the layer of high density foam is maintained; and lines of stitching being placed across the layer of high density foam, said outer layer of fabric and said inner layer of fabric of the bottom panel using said sewing machine.

13. The system of claim 8 further comprising:

a plurality of high density foam panels being formed into a single elongated strip of high density foam having a predetermined thickness to create the layer of high density foam of the top sleep panel.

14. The system of claim 12 further comprising:

a plurality of high density foam panels being formed into a single elongated strip of high density foam having a predetermined thickness to create the layer of high density foam of the bottom panel.

* * * * *